US005152468A

United States Patent [19]

Virtamo et al.

[11] Patent Number: 5,152,468

[45] Date of Patent: Oct. 6, 1992

[54] GYRATORY CRUSHER

[75] Inventors: Jussi Virtamo, Tampere; Markku Ruokonen, Lempäälä, both of Finland

[73] Assignee: Lokomo Oy, Tampere, Finland

[21] Appl. No.: 758,371

[22] Filed: Aug. 23, 1991

Related U.S. Application Data

[63] Continuation of Ser. No. 552,011, Jul. 13, 1990, Pat. No.

[30] Foreign Application Priority Data

Jul. 14, 1989 [FI] Finland ..... 893417

[51] Int. Cl.[5] ..... B02C 2/04

[52] U.S. Cl. ..... 241/213; 241/215

[58] Field of Search ..... 241/207, 208, 209, 210, 241/211, 212, 213, 214, 215, 216

[56] References Cited

U.S. PATENT DOCUMENTS

| | | | |
|---|---|---|---|
| 2,579,516 | 12/1951 | Roubal . | |
| 2,833,486 | 5/1958 | MacLeod | 241/215 |
| 3,423,033 | 1/1969 | Durand | 241/215 X |
| 3,788,569 | 1/1974 | Kemnitz . | |
| 4,034,922 | 7/1977 | Coxhill . | |
| 4,391,414 | 7/1983 | Reiter | 241/213 |
| 4,399,087 | 7/1982 | Pollak | 241/207 X |

FOREIGN PATENT DOCUMENTS

| | | |
|---|---|---|
| 2307022 | 8/1974 | Fed. Rep. of Germany . |
| 55452 | 4/1979 | Finland . |
| 1051428 | 1/1954 | France . |
| 1303086 | 7/1962 | France . |
| 56153 | 5/1967 | German Democratic Rep. . |
| 739348 | 10/1955 | United Kingdom . |

OTHER PUBLICATIONS

Morgårdshammar Gyratory Crushers Smedjebacken, Sweden, pp. 7 to 9.

GRAVIMATIC gyratory granulators and crushers, Models 800-1000 1250-1600.

H-200 Hydrocone SvedalaArbrå.

Lokomo G800-sarjan karamurskaimet G128, G78, G48.

*Primary Examiner*—Joseph M. Gorski

*Attorney, Agent, or Firm*—Burns, Doane, Swecker & Mathis

[57] ABSTRACT

The invention relates to a gyratory crusher in which a piston surrounds a wabbler shaft or eccentric sleeve and the radial forces of the spindle shaft are transmitted to the frame of the crusher through the piston.

3 Claims, 1 Drawing Sheet

GYRATORY CRUSHER

This application is a continuation of application Ser. No. 07/552,011, filed Jul. 13, 1990 and now abandoned.

BACKGROUND AND SUMMARY OF THE INVENTION

This invention concerns a gyratory crusher and especially mounting of its spindle shaft in bearings and its adjusting piston.

In this invention the term gyratory crusher means all spindle and cone crushers that operate on this adjusting principle, wherein the crushing takes place between two, generally conical crushing heads, regardless of the technical realization of the construction.

In the usual gyratory crusher the spindle shaft with its inner crushing head rests together with the thrust bearing combination on top of the adjusting piston and the radial forces of the crusher are transmitted to the frame from above the adjusting piston. One disadvantage of this solution is the unevitable fact that the crusher is constructed to be quite high.

One gyratory crusher of the type mentioned above is known from Finnish Patent Publication No. 55452.

In the present invention the adjusting piston of the crusher is used as a radial bearing of the crusher. The construction consists of a plunger piston, through which the radial forces of the crusher are transmitted to the frame of the crusher.

With a crusher according to the invention the construction height can be made lower than that of the solutions already known. In this way both the loading height and the transport height are lower, in consequent of which the crushing plant can be placed in a smaller area and transport of the crusher under bridges etc. is easier.

BRIEF DESCRIPTION OF THE DRAWING

In drawings of the description.

DETAILED DESCRIPTION OF THE INVENTION

Figure 1:
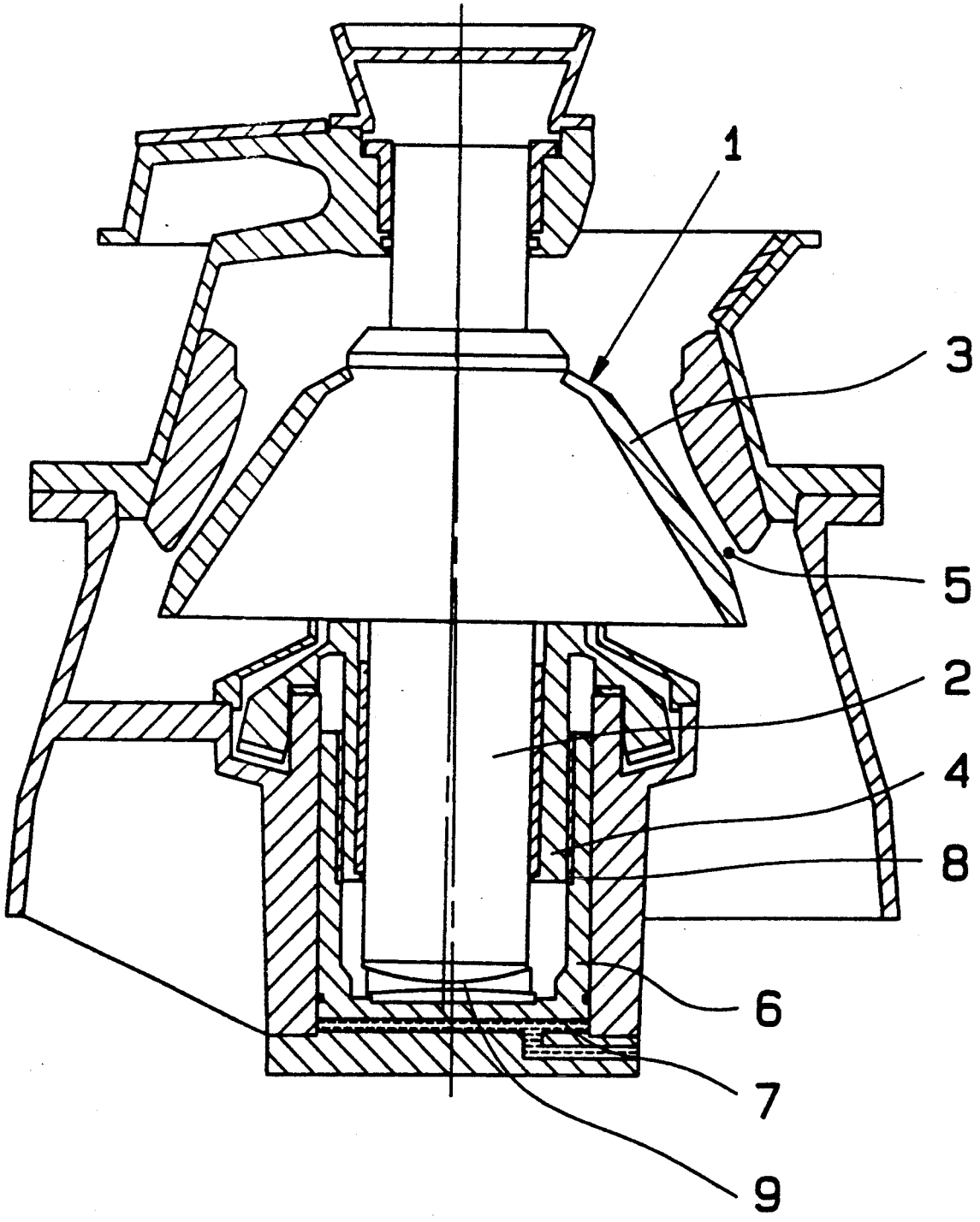
FIG. 1 shows schematically a sectional drawing of a gyratory crusher according to the invention, viewed from one side.

The gyratory crusher comprises a spindle 1 comprising a conic crushing head 3, fitted on to the spindle shaft 2. Diagonal hole in an eccentric inclined bore of the wabbler shaft or eccentric sleeve 4 causes, during the working cycle, constrained pendulous motion of the spindle 1, which closes and opens the crushing gap 5 between the crushing heads causing the rocks to be crushed. The smallest crushing gap 5 during the working cycle is obtained by adjustment of the gyratory crusher. The setting or adjustment of the gap can be changed with the help of hydraulic control equipment by conveying hydraulic medium to the space 7 between the plunger piston 6 and an end face of the crusher in contact with a radial hearing 8, whereupon the spindle 1 is moved upwardly as viewed in the drawing figure and reduces the adjustment, i.e., closes the gap 5. Consequently by removing hydraulic medium from the space 7 the spindle 1 goes down and enlarges the adjustment, i.e., opens the gap 5.

The plunger piston 6 is an open-top cylinder. The lower end of the spindle shaft 2 rests on the bottom of the cylinder on a thrust bearing 9. The upper part of the cylinder is supported on the exterior surface of the wabbler shaft or eccentric sleeve 4 by using a radial bearing 8. Thus, the radial forces from the spindle shaft 2 are transmitted through the adjusting piston to the frame of the crusher.

We claim:

1. A gyratory crusher, comprising:

a frame;

a rotating eccentric sleeve having an eccentric bore extending therethrough;

a spindle shaft rotatably mounted within said eccentric bore;

a piston vertically movably mounted within said frame, said piston comprising a hollow open-top cylinder;

said sleeve being rotatably mounted within said piston such that a first end of said spindle shaft supports a crushing head and a second, opposite end of said spindle shaft extends beyond a bottom end of said sleeve and engages with an interior surface of said piston by means of a thrust bearing located between said second, opposite end and said interior surface of said piston; and radial bearing means mounted between said sleeve and said piston for transmitting radial forces of said spindle shaft to the frame by means of the piston.

2. The crusher of claim 1, further comprising hydraulic means for regulating the position of the piston with respect to the frame.

3. The crusher of claim 1, wherein said eccentric bore is inclined.

* * * * *